US009474127B2

(12) United States Patent
Ido et al.

(10) Patent No.: US 9,474,127 B2
(45) Date of Patent: Oct. 18, 2016

(54) LIGHTING SYSTEM AND LUMINAIRE

(71) Applicant: Panasonic Corporation, Osaka (JP)

(72) Inventors: Shigeru Ido, Osaka (JP); Masahiro Naruo, Osaka (JP); Kenichi Fukuda, Osaka (JP); Sana Esaki, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 595 days.

(21) Appl. No.: 13/670,551

(22) Filed: Nov. 7, 2012

(65) Prior Publication Data

US 2013/0113394 A1 May 9, 2013

(30) Foreign Application Priority Data

Nov. 8, 2011 (JP) ..... 2011-244667

(51) Int. Cl.
*H05B 37/02* (2006.01)
*H05B 33/08* (2006.01)

(52) U.S. Cl.
CPC ..... *H05B 37/02* (2013.01); *H05B 33/086* (2013.01)

(58) Field of Classification Search
CPC . H05B 33/086; H05B 37/0281; H05B 37/02
USPC ..... 315/291, 294, 307, 312
See application file for complete search history.

(56) References Cited

U.S. PATENT DOCUMENTS 4,198,574 A * 4/1980 Price et al. ..... 307/97
4,521,843 A * 6/1985 Pezzolo et al. ..... 700/16
4,570,216 A * 2/1986 Chan ..... 700/14
6,013,987 A * 1/2000 Platt ..... 315/185 R
6,690,121 B1 * 2/2004 Weindorf ..... 315/247
8,441,201 B2 * 5/2013 Aso ..... H05B 33/0809 315/276
2003/0156422 A1 8/2003 Tatewaki et al.
2005/0111231 A1 * 5/2005 Crodian et al. ..... 362/545

(Continued)

FOREIGN PATENT DOCUMENTS

CN 101658071 2/2010
CN 101801146 8/2010

(Continued)

OTHER PUBLICATIONS

Chinese Office Action dated Jul. 2, 2014 issued in a corresponding Chinese application No. 201210445183.9 and the English translation thereof.
Japanese Office Action dated Apr. 21, 2015 issued in corresponding Japanese application No. 2011-244667 and English summary thereof.
Chinese Office Action dated Jul. 15, 2015 issued in corresponding Chinese Patent Application No. 201210445183.9 and English translation thereof.

*Primary Examiner* — Tung X Le
(74) *Attorney, Agent, or Firm* — Renner, Otto, Boisselle & Sklar, LLP

(57) ABSTRACT

A lighting system for controlling a plurality of light sources includes at least a first and a second light source, the second light source having a color temperature and relative luminous efficiency higher than those of the first light source. Further, the system includes: a driving unit configured to turn on and off each of the light sources; and a control unit configured to transmit a control signal to the driving unit in response to an input signal. In addition, the control unit transmits the control signal to the driving unit, to perform at least one of a fade-in control in which the first light source is turned on prior to the second light source when turning on the light sources and a fade-out control in which the second light source is turned off or is dimmed, prior to the first light source when turning off the light sources.

8 Claims, 10 Drawing Sheets

(56) References Cited

U.S. PATENT DOCUMENTS

| | | | | |
|---|---|---|---|---|
| 2008/0048582 | A1* | 2/2008 | Robinson | 315/291 |
| 2008/0186256 | A1 | 8/2008 | Readler | |
| 2009/0195169 | A1* | 8/2009 | Huang | H05B 33/0851 315/193 |
| 2010/0007292 | A1 | 1/2010 | Horino | |
| 2010/0019692 | A1* | 1/2010 | Kimura | H05B 33/0815 315/294 |
| 2010/0148703 | A1 | 6/2010 | Mizuno | |
| 2010/0237799 | A1* | 9/2010 | Choi | H02M 3/285 315/294 |
| 2010/0244743 | A1* | 9/2010 | Onishi et al. | 315/307 |

FOREIGN PATENT DOCUMENTS

| | | |
|---|---|---|
| CN | 201561393 | 8/2010 |
| JP | 2003-212037 | 7/2003 |
| JP | 2007-287617 | 11/2007 |
| JP | 2011-034780 | 2/2011 |

* cited by examiner

LIGHTING SYSTEM AND LUMINAIRE

FIELD OF THE INVENTION

The present invention relates to a lighting system and a luminaire for performing lighting control (dimming) or color mixing by using a plurality of light sources having different colors.

BACKGROUND OF THE INVENTION

Recently, a luminaire employing a light emitting device (LED) has been widely used as a light source for illumination. Accordingly, there is a growing demand for luminaires with high-functionality and low-cost. Compared to incandescent lights and discharge lamps, it is possible to more freely and easily control a color of light and perform lighting control (dimming) and mixing colors depending on the situation by using the LEDs, which has led to the development of various luminaires using LEDs.

These kinds of luminaires employ technologies which combine different colored LEDs to obtain a desired color of light and/or technologies which control a light emitting period of time and a light-emitting start timing. FIG. 11 illustrates an example of a conventional lighting system and a conventional luminaire, which are disclosed in, e.g., Japanese Patent Application Publication No. 2011-34780.

FIG. 11 illustrates a block diagram of a conventional lighting system and a conventional luminaire.

The conventional luminaire 100 includes a plurality of LEDs 200 having different colors such as red, green, and blue, and adjusts light outputs of the LEDs 200 to synthesize a desired chromaticity. In addition, the luminaire 100 includes a lighting system 300. The lighting system 300 includes a light receiving element A for measuring an amount of light emitted from each of the LEDs 200; a control unit such as a micro-computer 600 which controls periodical turning on/off of the LEDs 200 or a light-emitting time period of one cycle; and a driving circuit 700.

In the conventional luminaire 100, a current flowing in each of the LEDs is set to a predetermined value and a pulse width modulation (PWM) control is performed. Accordingly, each of the LEDs 200 is periodically turned on and off and a ratio of the light-emitting time period to one cycle (hereinafter, referred to as 'on duty ratio') is controlled with respect to each of the LEDs 200, thereby controlling the light output of each LED 200. In the luminaire 100, further, based on the amount of light measured by the light receiving element A, a light-emitting start time of one of the LEDs 200 is controlled to be faster than those of the other LEDs. As a result, it is disclosed that the one LED emits the light solely.

The conventional luminaire 100 obtains a desired chromaticity by measuring an amount of light emitted from the plurality of LEDs 200 using one light receiving element A and adjusting light-emitting start timings of the plurality of LEDs 200 periodically turning on and off. However, in order to obtain the desired chromaticity, the luminaire 100 is required to have the expensive light receiving element A. In addition, since there is a need of periodically turning on and off the LEDs 200, flickering is easy to occur.

SUMMARY OF THE INVENTION

Therefore, in light of the above, the present invention provides a lighting system capable of reducing discomfort feeling when a light source is lit on or off in order to perform lighting control or color mixing operations while effectively suppressing flickering, and a luminaire having the lighting system.

In accordance with an aspect of the present invention, there is provided a lighting system controlling a plurality of light sources which includes at least a first and a second light source, the first and the second light source having different luminous colors from each other, the system including: a driving unit configured to turn on and off each of the light sources; and a control unit configured to transmit a control signal to the driving unit in response to an input signal, wherein the second light source has a color temperature and relative luminous efficiency higher than those of the first light source, and wherein the control unit transmits the control signal to the driving unit, to perform at least one of a fade-in control in which the first light source is turned on prior to the second light source when turning on the light sources and a fade-out control in which the second light source is turned off or is dimmed, prior to the first light source when turning off the light sources.

Further, the control unit may control the first light source to first turn on by the fade-in control and the second light source to first turn off by the fade-out control.

The lighting system may further include smoothing circuits disposed between the driving unit and the respective light sources. Preferably, each of the smoothing circuits includes a capacitor and a resistor, and has a same time constant.

Further, the control unit includes: a lights-out measuring unit configured to measure a lights-out duration time in response to a turning-off command; and an output unit configured to receive the measured lights-out duration time from the lights-out measuring unit, wherein a lighting timing of the second light source may be delayed based on the measured lights-out duration time when performing the fade-in control.

An amount of time for delaying the lighting timing preferably changes depending on a dimming level or the measured lights-out duration time.

Each of the smoothing circuit may further include a voltage detecting unit to detect a voltage across the corresponding light source connected thereto, wherein, when turning on the light sources, the control unit outputs a control signal to maintain a voltage across the second light source under a lighting voltage of the second light source until a voltage across the first light source reaches a lighting voltage of the first light source.

Preferably, the first light source emits a red light, and the second light source emits a green light.

In accordance with another aspect of the present invention, there is provided a luminaire which includes the above-described lighting system.

BRIEF DESCRIPTION OF THE DRAWINGS

The above and other objects and features of the present invention will become apparent from the following description of embodiments given in conjunction with the accompanying drawings, in which.

DETAILED DESCRIPTION OF THE EMBODIMENTS

Hereinafter, embodiments of the present invention will be described in detail with reference to FIGS. 1 to 10 which form a part hereof.

First Embodiment

Figure 1:
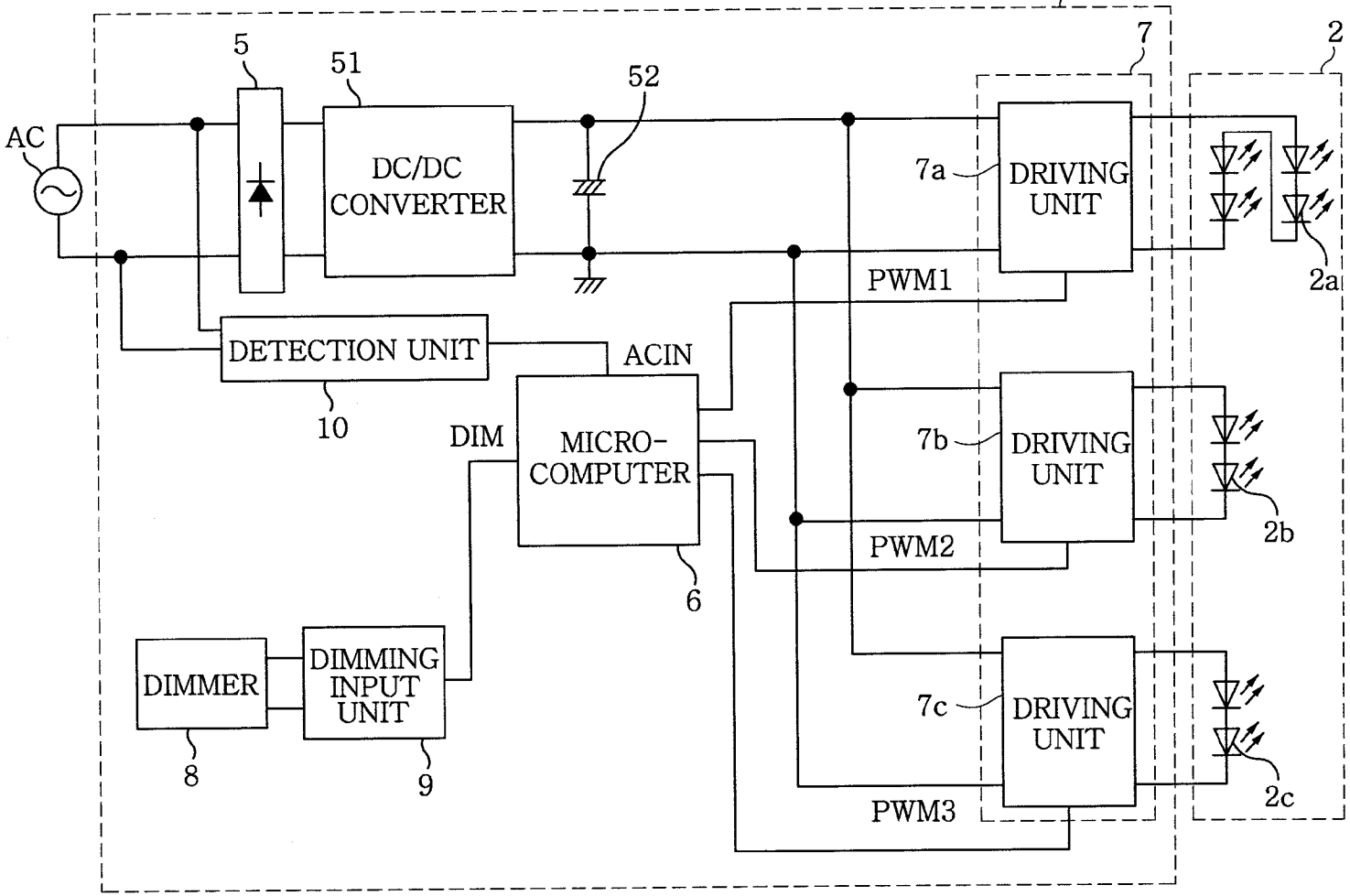
FIG. 1 illustrates a circuit diagram for explaining a lighting system and a luminaire in accordance with a first embodiment of the present invention.

A lighting system and a luminaire in accordance with a first embodiment of the present invention will be described with reference to FIG. 1.

The luminaire 1 in accordance with the first embodiment includes a plurality of LEDs 2, which are light sources emitting different colors of light from each other. In the present embodiment, the lighting sources emit, e.g., three different colors of light such as red, green, and blue. A first light source, a red LED 2*a*, may include a GaAsP LED element. A second light source, a green LED 2*b*, may include a GaP LED element. A third light source, a blue LED 2*c*, may include a GaN LED element. Alternatively, the red LED 2*a* and the green LED 2*b* may be obtained by converting a wavelength of a white LED using a fluorescent substance.

In the present embodiment, the red LED 2*a* includes 4 LED elements coupled in series. Each of the green LED 2*b* and the blue LED 2*c* includes two LED elements electrically coupled in series. Moreover, the LED 2 may include a package or a chip.

The luminaire 1 further includes a lighting system 3. The lighting system 3 further includes a rectifier 5, a micro-computer 6, a driving unit 7, a dimmer 8, and a dimming input unit 9, which are electrically connected to each other. The lighting system 3 receives a power from an alternative current (AC) power supply AC such as a commercial power supply. The rectifier 5 rectifies the AC power to generate a direct current (DC) power with a ripple current. The DC power is converted into a desired DC power by a DC/DC converter 51, and smoothed by a capacitor 52. Thus, a supply voltage VO as a DC is outputted to the LED 2.

The micro-computer 6 serving as a control unit performs analog-to-digital conversion on a DIM signal inputted from the dimming input unit 9, and determines a cycle and a duty ratio of a pulse width modulation (PWM) signal which depends on a target color temperature and a target luminous flux corresponding to an input signal. The PWM signal is inputted to the driving unit 7 as a control signal.

The driving unit 7 acts as a DC/DC converter to supply the supply voltage VO to each of the LEDs 2*a*, 2*b* and 2*c*, the supply voltage VO being a DC power. Further, the driving unit 7 performs a lighting control (dimming) operation in response to the PWM signal from the micro-computer 6. Herein, the driving unit 7*a* performs the lighting control operation in response to a PWM signal PWM1; the driving unit 7*b* performs the lighting control operation in response to a PWM signal PWM2; and the driving unit 7*c* performs the lighting control operation in response to a PWM signal PWM3. The driving units 7*a*, 7*b*, and 7*c* control the red LED 2*a*, the green LED 2*b*, and the blue LED 2*c*, respectively.

The dimmer 8 acts as an input unit to receive a dimming input from a user, and outputs a PWM signal or an asynchronous serial communications signal based on the dimming input. The dimmer 8 may be a wired operating handle or a receiving unit for receiving an input from a remote device. The dimming input unit 9 converts a signal from the dimmer 8 into a signal capable of being inputted to the micro-computer 6.

Additionally, the lighting system 3 includes a detection unit 10 that detects a voltage of the AC power supply AC and outputs a conducting state to the micro-computer 6. In addition, the micro-computer 6 outputs a lights-out control signal of the LED 2 in response to an ACIN signal outputted from the detection unit 10. Although the dimmer 8 and the dimming input unit 9 have been explained in the present embodiment, the lighting system 3 may include a color mixing (color temperature control) function.

The turning on/off of the LED 2 by the lighting system will be described with reference to timing diagrams of FIGS. 2 and 3. In the timing diagrams, a vertical axis represents a supply voltage VO and current IO to the LED 2 and a total intensity of illumination, and a horizontal axis represents a time t.

Figure 2:
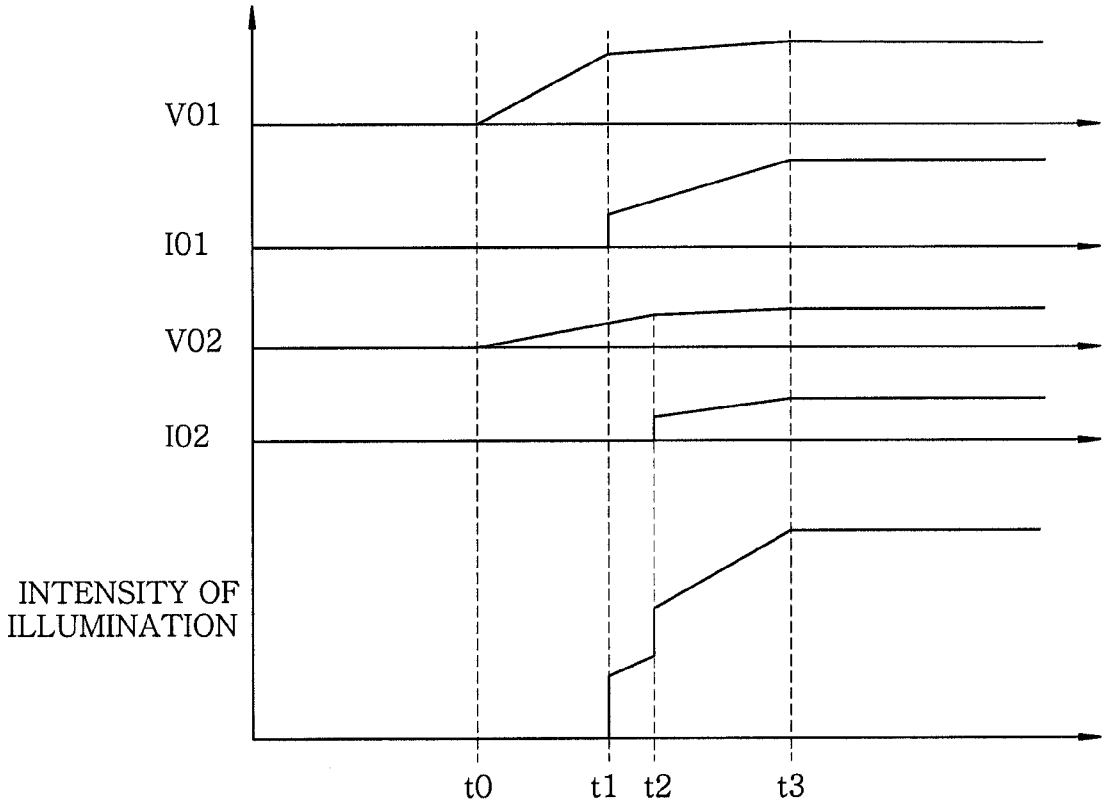
FIG. 2 is a timing diagram showing a voltage and a current supplied to each LED and the total intensity of illumination in case of turning on the luminaire in accordance with the first embodiment.

FIG. 2 illustrates an example which performs a fade-in control where the LED 2 switches from a lights-out state to a lighting state. Herein, the "lighting state" represents a state where the LED 2 is lit around a dimming lower limit. For instance, a current IO1 of the red LED 2*a* is set to about 1% of a current in a complete lighting state, and a current IO2 of the green LED 2*b* is set to about 0.5% of a current in a complete lighting state. Since the blue LED 2*c* is set not to be turned on around the dimming lower limit, its description will be omitted. In the timing diagrams, VO1 represents an output voltage of the driving unit 7*a*; IO1 represents a current of the LED 2*a*; VO2 represents an output voltage of the driving unit 7*b*; and IO2 represents a current of the LED 2*b*.

In the embodiment of the present invention, two colors of the red LED 2*a* and the green LED 2*b* have been explained. However, the present invention is not limited to the two colors. That is, light sources of more than two colors may be used.

Hereinafter, the voltage VO, the current IO, and the intensity of illumination are described with respect to each point of time of the horizontal axis in FIG. 2.

Before a point of time t0, the AC power is supplied and the DC/DC converter 51 controls a voltage across the capacitor 52 to be constant. When a dimming signal is inputted from the dimming input unit 9, the micro-computer 6 starts up and determines an output level based on the dimming signal.

At a point of time t0, the micro-computer 6 provides a PWM signal instructing each of the LEDs 2*a*, 2*b*, and 2*c* to start outputting. Accordingly, the output voltage VO1 of the driving unit 7*a* starts to increase. Likewise, the output voltage VO2 of the driving unit 7*b* also starts to increase.

At a point of time t1, the output voltage VO1 reaches a voltage level capable of turning on the LED 2*a*, and thus the LED 2*a* is turned on. Accordingly, the current IO1 flows in the LED 2*a*. Since, however, the current IO1 does not reach a target dimming level at this point of time, the current IO1 of the LED 2*a* increases with time. Thus, the intensity of illumination also starts to increase.

At a point of time t2, the output voltage VO2 reaches a voltage level capable of turning on the LED 2*b*, and thus the LED 2*b* is turned on. Accordingly, the current IO2 starts to flow. Since, however, the current IO2 does not reach a target dimming level at this point of time, the current IO2 of the LED 2*b* increases over time. It is preferred that the LED 2*b* is turned on within (t2–t1), e.g., 100 ms, after the LED 2*a* is turned on.

At a point of time t3, the current IO1 and the current IO2 reach predetermined current levels. The micro-computer 6 stops the increase of the outputs of the driving units 7*a* and 7*b*, and maintains the lighting state of the LED 2*a* and the LED 2*b*. As a result, the intensity of illumination reaches a desired level.

Figure 3:
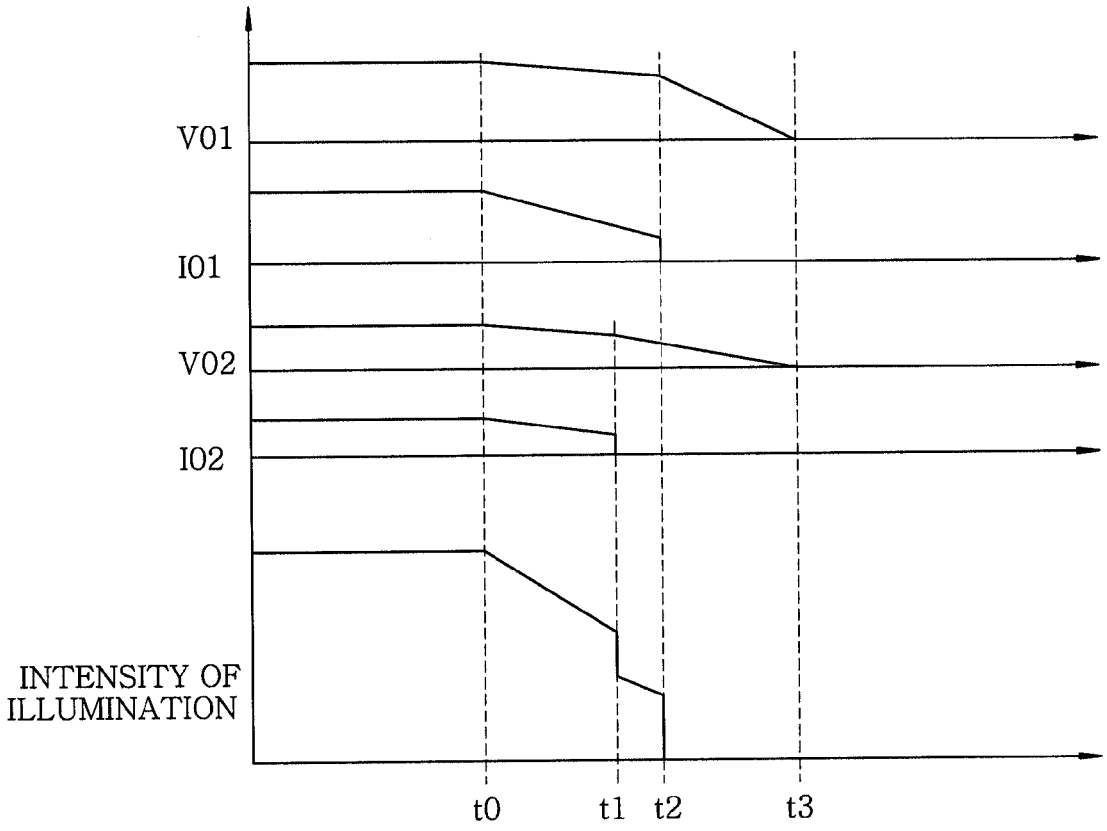
FIG. 3 is a timing diagram illustrating a voltage and a current supplied to each LED and the total intensity of illumination in case of turning off the luminaire in accordance with the first embodiment.

FIG. 3 illustrates an example of performing a fade-out control where the LED 2 moves from a lighting state to a lights-out state. The lighting state, terms and the like shown in FIG. 3 are identical to that of FIG. 2. Although the example of performing the lights-out as the fade-out control is illustrated in FIG. 3, the fade-out control may include dimming.

Hereinafter, a voltage VO, a current IO, and the intensity of illumination are described with respect to each point of time of a horizontal axis in FIG. 3.

Before a point of time t0, the micro-computer 6 maintains an output state depending on a previous dimming level.

At a point of time t0, a lights-out signal is inputted to the micro-computer 6. Accordingly, the micro-computer 6 controls the driving unit 7*a* to decrease the output voltage VO1. Likewise, the driving unit 7*b* also starts to decrease the output voltage VO2. As a result, the intensity of illumination also starts to decrease.

At a point of time t1, the output voltage VO2 of the driving unit 7*b* reaches a voltage level capable of turning off the LED 2*b*, so that the LED 2*b* is turned off. At this time, the current IO2 of the LED 2*b* becomes 0. The output voltage VO2 of the LED 2*b* is controlled to decrease over time. As a result, the intensity of illumination also decreases.

At a point of time t2, the output voltage VO1 of the driving unit 7*a* reaches a voltage level capable of turning off the LED 2*a*, and the LED 2*a* is turned off. At this time, the current IO1 of the LED 2*a* becomes 0. The output voltage VO1 of the LED 2*a* is controlled to decrease over time. As a result, the intensity of illumination also becomes 0.

At a point of time t3, the output voltage VO1 of the driving unit 7*a* and the output voltage VO2 of the driving unit 7*b* reach 0, and the micro-computer 6 stops the operations of the driving units 7*a* and 7*b* and maintains a lights-out state.

A color of light between red and yellow (which looks like a color of an incandescent lamp) can be reproduced by mixing a light from the red LED 2*a* and a light from the green LED 2*b*. In this case, a difference between the lighting start times of the LED 2*a* and the LED 2*b* may occur. For instance, a lighting start voltage may change due to a chip temperature change of the LED 2 or an output deviation of the driving unit 7. If the green LED 2*b* is turned on before the red LED 2*b* is turned on due to the change, the discomfort may occur.

In the luminaire 1 in accordance with the embodiment of the present invention, the red LED 2*a* having a relatively low color temperature and relatively low relative luminous efficiency is turned on prior to the green LED 2*b* in a lighting operation. On the other hand, the green LED 2*b* having a relatively high color temperature and relatively high relative luminous efficiency is turned off prior to the red LED 2*a* in a lights-out operation. As a result, it is possible to provide coziness or comfort through the light color of the red LED 2*a* and to appropriately reduce a discomfort feeling in turning on and off of the luminaire.

Alternatively, the red LED 2*a* may be turned on prior to the green LED 2*b* when turning on, or the green LED 2*b* may be turned off prior to the red LED 2*a* when turning off. Thus, it is possible to obtain the luminaire 1 in which the discomfort due to the discontinuity in color change is reduced.

The discomfort due to the discontinuity in color change will be described with reference to a graph in FIG. 4.

Figure 4:
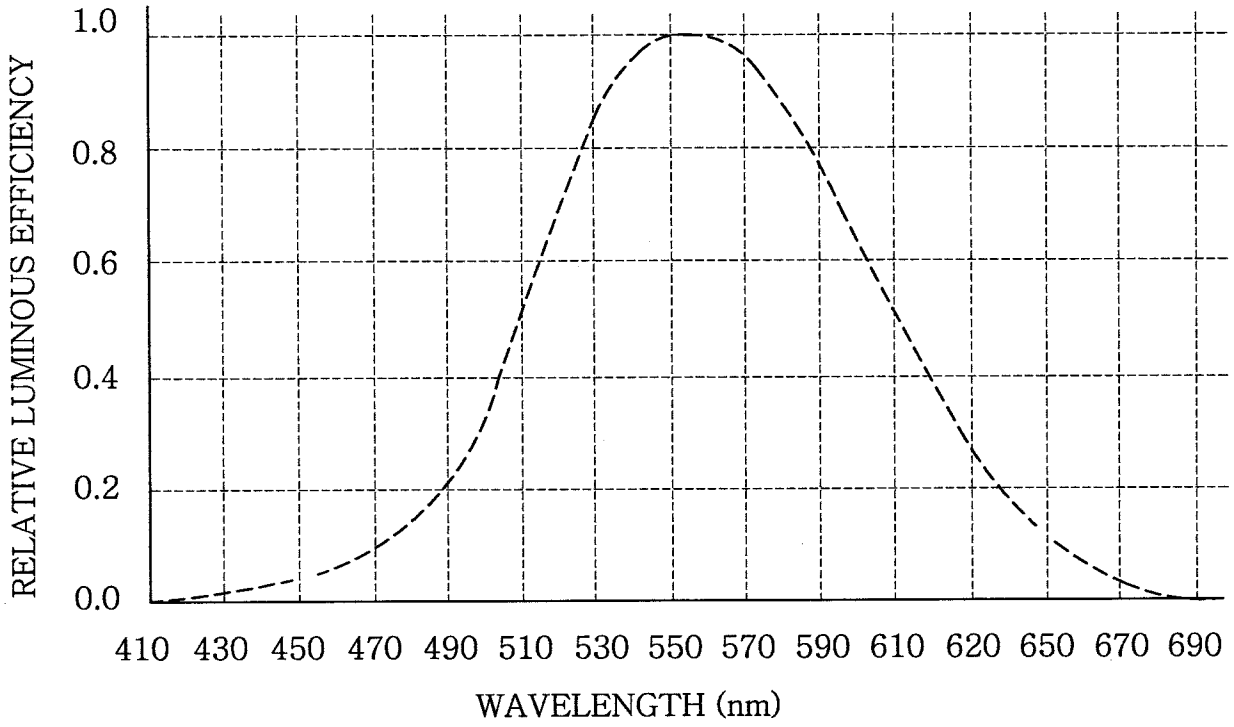
FIG. 4 is a graph showing relationships of a relative luminous efficiency and a wavelength with respect to the LED used in a lighting system and a luminaire in accordance with the present invention.

FIG. 4 illustrates a relative luminous efficiency curve, which shows sensitivities according to a wavelength of a light. Referring to FIG. 4, it is noted that from the green LED 2*b* is sensed the brightest provided that the LEDs 2 have the same intensity of light. According to a report from the CIE (Commission Internationale de l'Eclairage), an eye of a human being has the highest sensitivity around a wavelength of 555 nm in a bright place and around a wavelength of 507 nm in a dark place. In general, a color temperature of the red LED 2*a* is around 3000 K, that of the green LED 2*b* is around 5500 K, and that of the blue LED 2*c* is around 6500 K.

In the luminaire 1 in accordance with the present invention, flickering may be minimized by turning on the green LED 2*b* after the red LED 2*a* and turning off before the red LED 2*a*. Additionally, a color balance is maintained when beginning and ending the lighting control by turning on the red LED 2*a* before the green LED 2*b* and turning off after the green LED 2*b*, thereby realizing high color rendition, color mixing (color temperature control), and lighting control.

Second Embodiment

A lighting system and a luminaire in accordance with a second embodiment of the present invention will be described with reference to a circuit diagram of FIG. 5.

The configuration of the second embodiment is almost the same as that of the first embodiment, but the second embodiment further employs a smoothing circuit including a capacitor C and a resistor R, which are coupled in parallel and disposed between the driving unit 7 and the LED 2. A capacitor C1 and a resistor R1 are electrically coupled to and disposed between the driving unit 7*a* and the LED 2*a*. A capacitor C2 and a resistor R2 are electrically coupled to and disposed between the driving unit 7*b* and the LED 2*b*. A capacitor C3 and a resistor R3 are electrically coupled to and disposed between the driving unit 7*c* and the LED 2*c*. The capacitors C1, C2, and C3 have the same capacitance c, i.e., c1=c2=c3. In addition, the resistors R1, R2, and R3 have the same resistance r, i.e., r1=r2=r3. In accordance with the second embodiment, a current ratio is fixed by adjusting a time constant (r×c).

Figure 6:
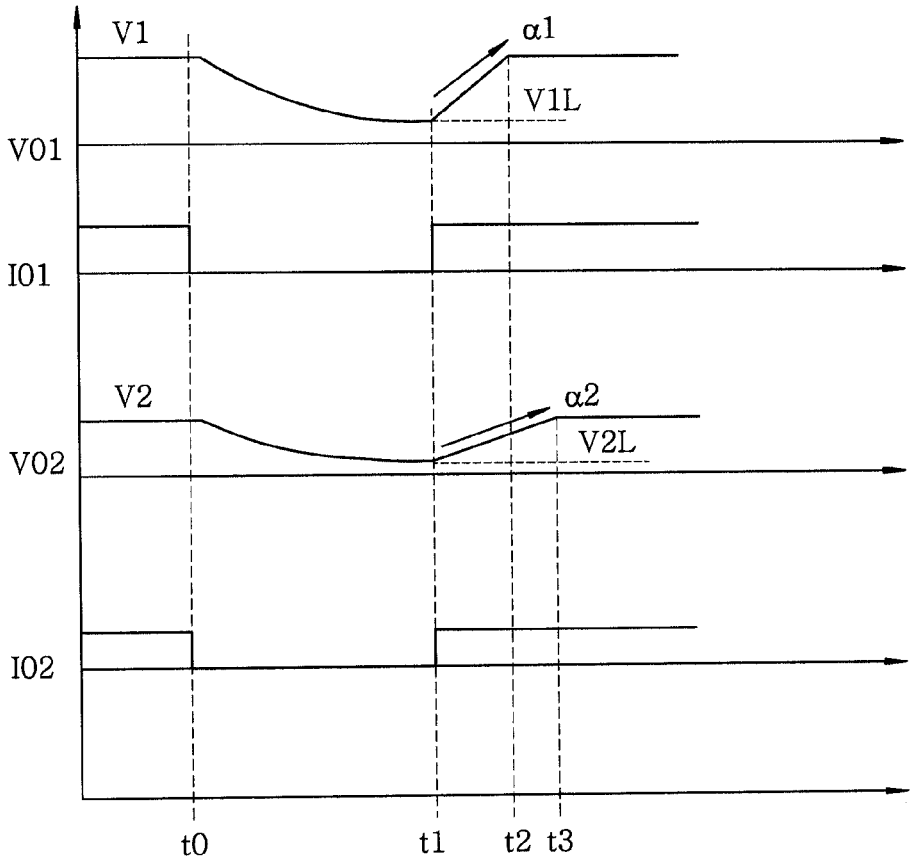
FIG. 6 depicts a timing diagram showing a voltage and a current supplied to each LED when a lights-out operation is performed and then a fade-in control is performed in the luminaire in accordance with the second embodiment.

Hereinafter, with reference to a timing diagram of FIG. 6, there will be described a voltage VO and a current IO supplied to the LEDs with respect to each point of time in a case where the LED 2 moves to a lights-out state and then the fade-in control is performed by the lighting system 3 of the present embodiment.

Before a point of time t0, the micro-computer 6 maintains an output state depending on a previous dimming level. In the present embodiment, V1 represents a lighting voltage of the LED 2*a*, and V2 represents a lighting voltage of the LED 2*b*.

At a point of time t0, a lights-out signal is inputted to the micro-computer 6, and the micro-computer 6 controls the driving unit 7*a* and the driving unit 7*b* to stop outputting accordingly. As a result, there occurs a voltage drop in the output voltage VO1 of the driving unit 7*a* based on a time constant (c1×r1) of the smoothing circuit. Likewise, the output voltage VO2 of the driving unit 7*b* also decreases based on a time constant (c2×r2) of the smoothing circuit.

At a point of time t1, a lighting signal is inputted to the micro-computer 6. The micro-computer 6 controls the driving unit 7*a* and the driving unit 7*b* to resume outputting accordingly. The output voltage VO1 of the driving unit 7*a* increases in a change speed of α1. If a voltage V1L indicates the output voltage VO1 at the point of time t1, the output voltage VO1 reaches a lighting voltage V1 at (V1−V1L)/α1. Since α1 is represented as IO1/c1 when a current flowing through the resistor R1 is negligible, and α1 is proportional to the current IO1.

Likewise, the output voltage VO2 of the driving unit 7*b* increases in a changing speed of α2. If a voltage V2L indicates the output voltage VO2 at the point of time t1, the output voltage VO2 reaches a lighting voltage V2 at (V2−V2L)/α2. Since α2 is represented as IO2/c2 when a current flowing through the resistor R2 is negligible, and α2 is proportional to the current IO2.

At a point of time t2, the output voltage VO1 reaches the lighting voltage V1, and thus the LED 2*a* is turned on.

At a point of time t3, the output voltage VO2 reaches the lighting voltage V2, and thus the LED 2*b* is turned on. As a result, a light from the LED 2*b* is outputted in the dimming lower limit.

The second embodiment of the present invention is characterized in that the time constant of the smoothing circuit is set constantly. With this configuration of the second embodiment, it is possible to prevent a change in the lighting timings of the red LED 2*a* and the green LED 2*b*, wherein the variation may be caused by residual charges in the capacitor C. In case that the lighting voltage V1 of the LED 2*a* is different from the lighting voltage V2 of the LED 2*b*, it is possible to adjust charge times of the capacitors C by setting V1:V2=IO1:IO2=α1:α2.

This setting may put limitation on color setting, but it is possible to make a color change invisible by changing the current IO1 and the current IO2 to desired currents after starting the lighting operation. As in the first embodiment, the PWM signal outputted from the micro-computer 6 may be set to have, e.g., IO1>IO2×(V1/V2), such that the LED 2*a* is turned on before the LED 2*b*. Thus, since the LED 2*a* is certainly turned on before the LED 2*b*, it is possible to reduce a discomfort at a starting point of the lighting operation.

The second embodiment shows an example of employing a capacitor with a relatively high capacitance between both ends of the LED 2 as a load. According to this configuration, since the variation of a peak current/voltage of the LED 2 is reduced, an electrical stress or efficiency of the LED 2 is improved, so that it is possible to implement a design in which flickering is further reduced. Therefore, it is possible to remove defects of the prior art, e.g., a deviation of lighting timing and a long charging time, which occur when turning on the LED 2 in the dimming lower limit. Through the use of the luminaire 1 in accordance with the present invention, it is possible to realize the lighting start having high efficiency, less flickering, and reduced discomfort in the lighting control and color mixing.

Third Embodiment

Figure 7:
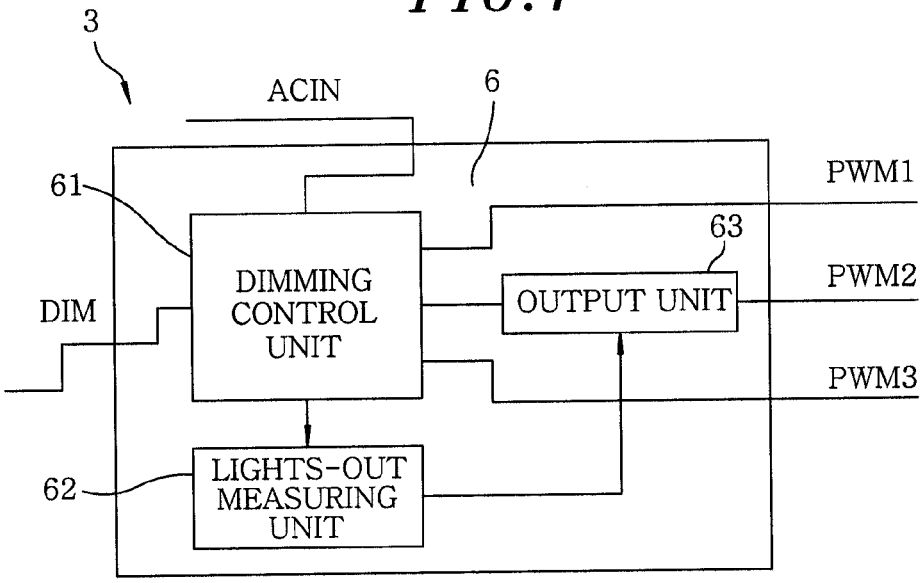
FIG. 7 represents a circuit diagram of a micro-computer for explaining a lighting system and a luminaire in accordance with a third embodiment of the present invention.

A lighting system and a luminaire in accordance with a third embodiment of the present invention will be described with reference to a circuit diagram of a micro-computer shown in FIG. 7. Since the other configuration than the micro-computer 6 is the same as that of the second embodiment, the explanation will focus on a difference between the second embodiment and the third embodiment.

The micro-computer 6 in accordance with the third embodiment includes a dimming control unit 61, and a lights-out measuring unit 62 and an output unit 63 to implement the third embodiment. The dimming control unit 61 performs analog-to-digital (A/D) conversion on the DIM signal inputted from the dimming input unit 9, and determines a cycle and a duty ratio of the PWM signal to obtain a target color temperature and a target luminous flux, which correspond to the input signal DIM. The dimming control unit 61 also performs a lights-out control according to a conducting state of the AC power supply AC.

The lights-out measuring unit 62 measures a lights-out duration time after a turning-off command is applied to the dimming control unit 61 in response to the blocking of the AC power supply AC or the signal DIM from the dimming input unit 9. After that, when a turning-on command is provided to the dimming control unit 61 and thus the luminaire 1 moves to a lighting state, the lights-out measuring unit 62 transmits the measured lights-out duration time to the output unit 63.

The output unit 63 determines a delay time of a PWM signal PWM2 supplied to the green LED 2*b* based on the measured lights-out duration time. The PWM signal PWM2 is maintained at a lights-out level during the delay time after the lighting operation of the LED 2*b* starts. The other configuration of the third embodiment is basically the same as that of the first or second embodiment.

Figure 8:
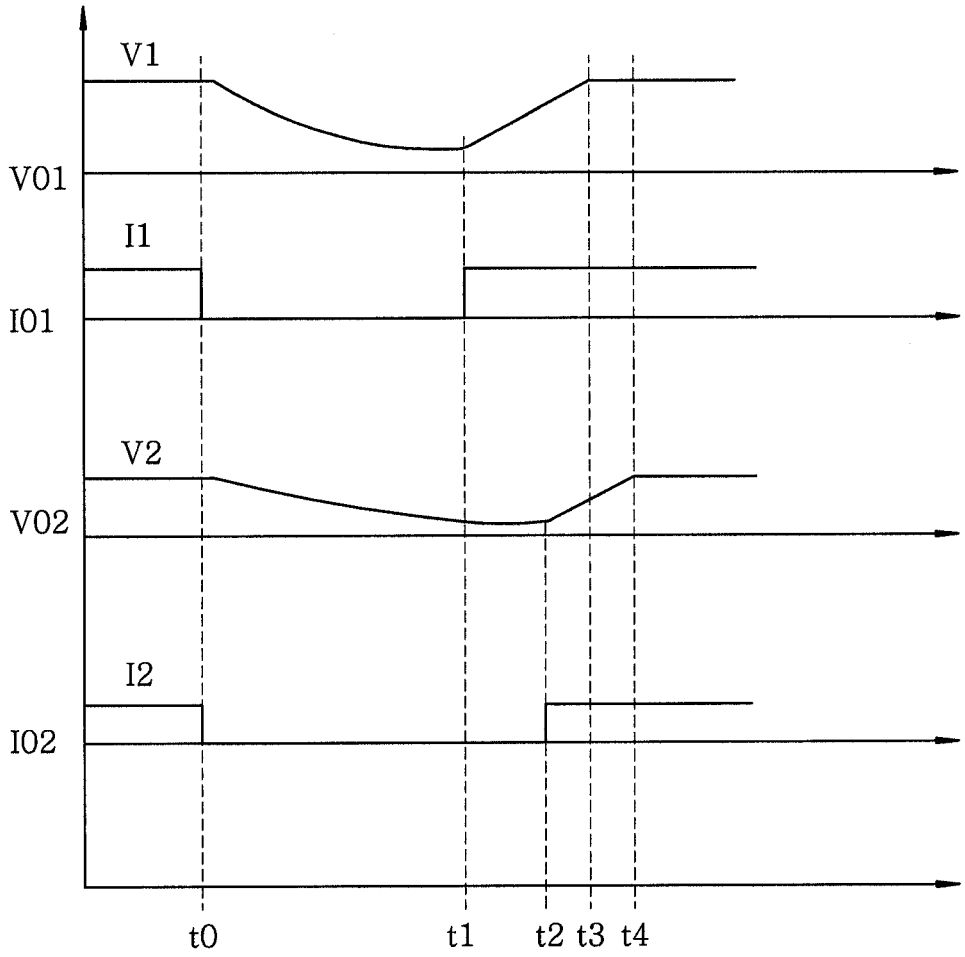
FIG. 8 illustrates a timing diagram showing a voltage and a current supplied to each LED when a lights-out operation is performed and then a fade-in control is performed in the luminaire in accordance with the third embodiment.

Hereinafter, with reference to a timing diagram of FIG. 8, there will be described a voltage VO and a current IO supplied to the LEDs 2 with respect to each point of time in a case where the LED 2 moves to a lights-out state and then the fade-in control is performed by the lighting system 3 using the micro-computer 6 in accordance with the third embodiment.

Before a point of time t0, the micro-computer 6 maintains an output state depending on a previous dimming level. V1 represents a lighting voltage of the LED 2*a*, and V2 represents a lighting voltage of the LED 2*b*. I1 represents a current of the LED 2*a*, and I2 represents a current of the LED 2*b*. The other configuration is substantially the same as that of the second embodiment.

At a point of time t0, a lights-out signal is inputted to the micro-computer 6, and the dimming control unit 61 of the micro-computer 6 controls the driving unit 7*a* and the driving unit 7*b* to stop outputting accordingly. As a result, there occurs a voltage drop in the output voltage VO1 of the driving unit 7*a* based on a time constant (c1×r1) of the smoothing circuit. Likewise, the output voltage VO2 of the driving unit 7*b* also decreases based on a time constant (c2×r2) of the smoothing circuit. The lights-out measuring unit 62 starts to measure a lights-out duration time.

At a point of time t1, a lighting signal is inputted to the micro-computer 6. The lights-out measuring unit 62 terminates the measuring of the lights-out duration time, and transmits the measured lights-out duration time (t1−t0) to the output unit 63. Accordingly, the output unit 63 starts to delay the PWM signal PWM2 outputted from the dimming control unit 61. Meanwhile, during the delay operation, the PWM signal PWM1, which is not delayed, is transmitted to the driving unit 7*a*, so that the driving unit 7*a* starts to perform an output operation and thus the supply voltage VO1 starts to increase.

At a point of time t2, the lights-out measuring unit ends the delay operation so that the delay of the PWM signal PWM2 is stopped, and the PWM signal PWM2 is transferred to the driving unit 7*b*. Accordingly, the driving unit 7*b* starts to perform an output operation, and thus the supply voltage VO2 starts to increase.

At a point of time t3, the supply voltage VO1 reaches the lighting voltage V1, and thus the LED 2*a* is turned on.

At a point of time t4, the supply voltage VO2 reaches the lighting voltage V2, and thus the LED 2*b* is turned on.

The third embodiment of the present invention is characterized by delaying the timing when the driving unit 7*b* starts to supply a power to the green LED 2*b* in the fade-in operation. Accordingly, even though the lighting start time of the LED 2*b* is set faster than that of the LED 2*a* by a deviation in setting a current or a time constant, it is possible to prevent the LED 2*b* from being turned on prior to the LED 2*a*. Further, it is possible to flexibly respond to a deviation in setting the current of the LED 2 as a load, or a design of the smoothing circuit.

In addition, a difference between the lighting start time of the LED 2*b* and that of the LED 2*a* varies depending on the lights-out duration time. Therefore, even in a case where the lights-out duration time is not constant, it is possible to reliably turn on the LED 2*a* prior to the LED 2*b* by varying the delay time of lighting the LED 2*b* according to the lights-out duration time.

For instance, when the lights-out duration time and the difference between the lighting start times of the LED 2*b* and the LED 2*a* based thereon becomes greater, or when the currents of the LED 2*a* and the LED 2*b* are changed in setting of the dimming level, it is possible to predict a required delay time and change the delay time through an arithmetic operation based on the required delay time. Particularly, in case of re-starting the lighting operation in a state where the current IO of the LED 2 is great, e.g., in a rated lighting current, it may be better to set the delay time as 0. That is, the delay time may be determined based on the dimming level of the LED 2.

Fourth Embodiment

Figure 9:
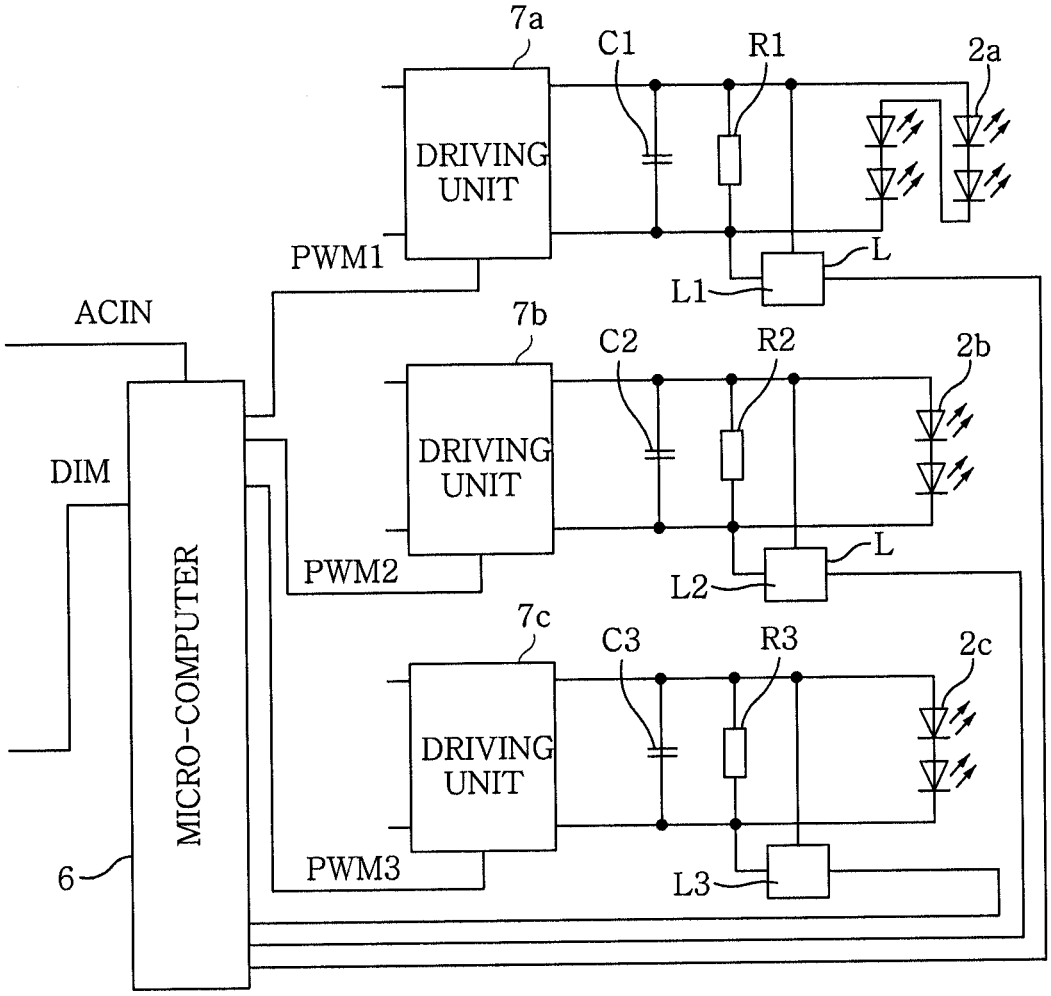
FIG. 9 presents a circuit diagram for explaining a lighting system and a luminaire in accordance with a fourth embodiment of the present invention.

A lighting system and a luminaire in accordance with a fourth embodiment of the present invention will be described with reference to a circuit diagram shown in FIG. 9.

Figure 5:
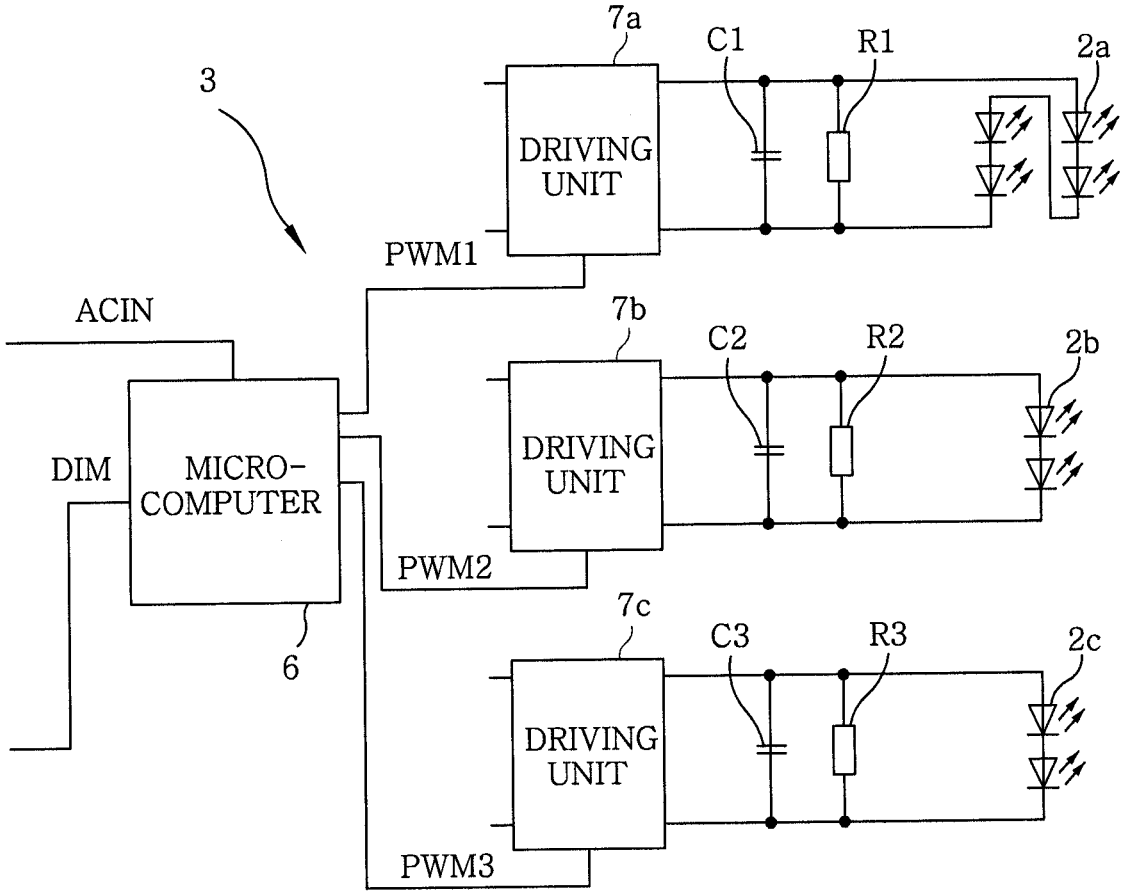
FIG. 5 illustrates a circuit diagram for explaining a lighting system and a luminaire in accordance with a second embodiment of the present invention.

In addition to the configuration of the second embodiment illustrated in FIG. 5, the fourth embodiment is characterized in that the smoothing circuit includes a voltage detecting unit L for detecting a voltage across the LED 2. The voltage detecting unit L is electrically connected to the micro-computer 6. If the detected voltage is equal to or smaller than a threshold voltage which does not turn on the LED2, a low voltage detection signal LOW is inputted to the micro-computer 6.

In this case, if a lighting voltage of the LED 2*a* in the dimming lower limit is 13 V, a voltage corresponding to 80% of 13 V, i.e., 10.4 V, is determined as the threshold voltage. Further, if a lighting voltage of the LED 2*b* in the dimming lower limit is 6.5 V, a voltage corresponding to 80% of 6.5 V, i.e., 5.2 V, is determined as the threshold voltage. The threshold voltage may be set to a value within a range which an error detection does not occur, without being limited to 80% of the lighting voltage in the dimming lower limit.

Figure 10:
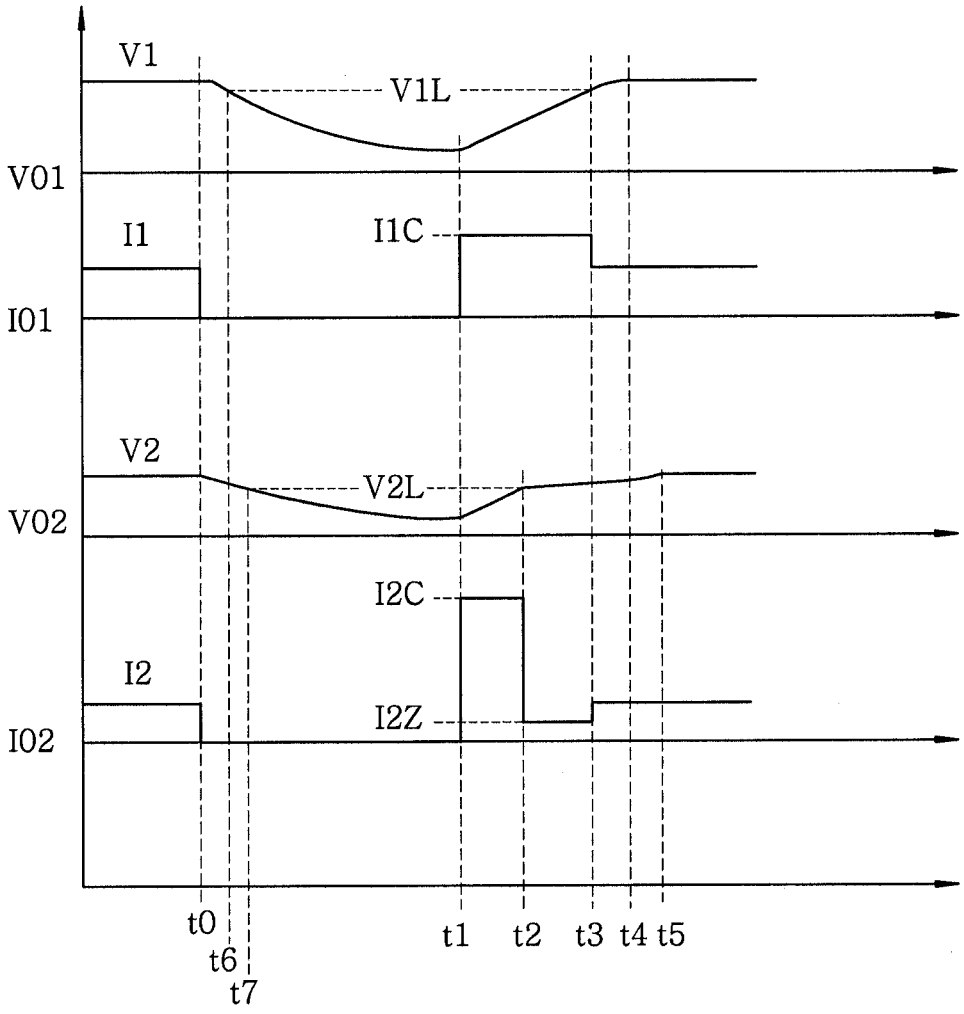
FIG. 10 illustrates a timing diagram of a voltage and a current supplied to each LED when a lights-out operation is performed and then a fade-in control is performed in the luminaire in accordance with the fourth embodiment.
Figure 11:
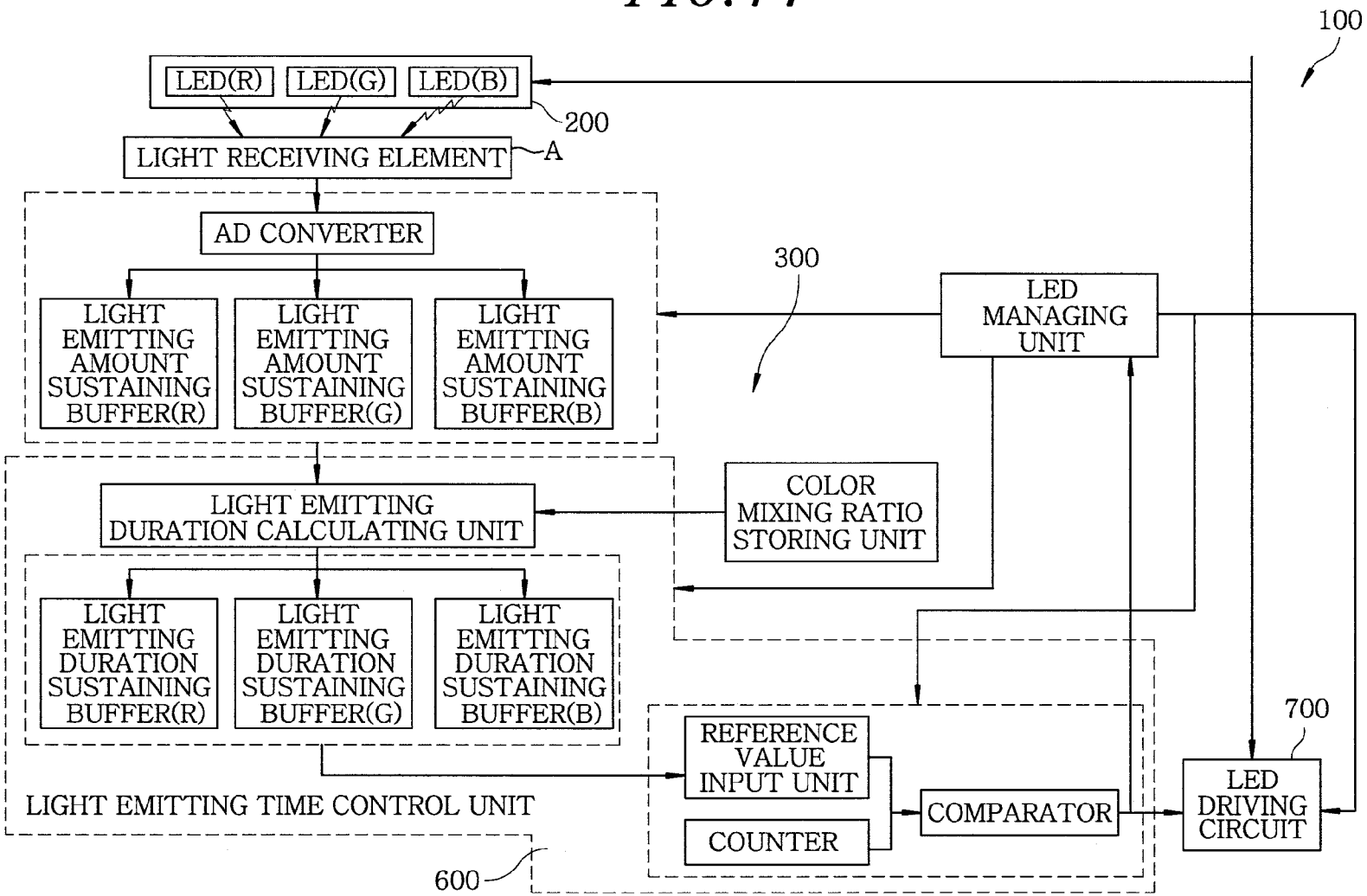
FIG. 11 depicts a block diagram of a conventional lighting system and luminaire.

Hereinafter, with reference to a timing diagram of FIG. 10, there will be described a supply voltage VO and a current IO with respect to each point of time in a case where the LED 2 moves to a lights-out state and then the fade-in control is performed by the lighting system 3 in accordance with the fourth embodiment.

Before a point of time t0, the micro-computer 6 maintains an output state depending on a previous dimming level. V1 represents a lighting voltage of the LED 2*a*, and V2 represents a lighting voltage of the LED 2*b*. I1 represents a current of the LED 2*a*, and I2 represents a current of the LED 2*b*.

At a point of time t0, a lights-out signal is inputted to the micro-computer 6, and the micro-computer 6 controls the driving unit 7*a* and the driving unit 7*b* to stop outputting accordingly. As a result, there occurs a voltage drop in the output voltage VO1 of the driving unit 7*a* according to a time constant (c1×r1) of the smoothing circuit. Likewise, the output voltage VO2 of the driving unit 7*b* also decreases based on a time constant (c2×r2) of the smoothing circuit.

At a point of time t6, the supply voltage VO1 drops into a voltage level smaller than a voltage level V1L that definitely turns off the LED 2*a*, and a voltage detecting unit L1 outputs a low voltage detection signal LOW. Likewise, at a point of time t7, the supply voltage VO2 drops into a voltage level smaller than a voltage level V2L that definitely turns off the LED 2*b*, and a voltage detecting unit L2 also outputs a low voltage detection signal LOW.

At the point of time t1, a lighting signal is inputted to the micro computer 6. The micro-computer 6 outputs the PWM signal PWM1 to the driving unit 7*a*, the PWM signal PWM1 setting up a current for initially charging the driving unit 7*a*. The output current IO1 of the driving unit 7*a* becomes I1C accordingly. At the same time, the micro-computer 6 outputs the PWM signal PWM2 to the driving unit 7*b*, the PWM signal PWM2 setting up a current for initially charging the driving unit 7*b*. The output current IO2 of the driving unit 7*b* becomes I2C accordingly. After that, the capacitors C1 and C2 start to be charged by the initial charge current.

At a point of time t2, the supply voltage VO2 reaches a voltage level higher than the voltage level V2L that definitely turns off the LED 2*b*, and the voltage detecting unit L2 outputs a high voltage detection signal HIGH. In response to the high voltage detection signal HIGH, the micro-computer 6 stops the initial charging operation on the capacitor C2. The micro-computer 6 outputs the PWM signal PWM2 to the driving unit 7*b*, the PWM signal PWM2 setting up a current level 12Z for constantly maintaining a charge state of the driving unit 7*b*. The current level 12Z is a current flowing in the resistor R2, i.e., V2L/r2.

At a point of time t3, the supply voltage VO1 reaches a voltage higher than the voltage level V1L that definitely turns off the LED 2*a*, and the voltage detecting unit L1 outputs a high voltage detection signal HIGH. In response to the high voltage detection signal HIGH, the micro-computer 6 stops the initial charging operation on the capacitor C1. The micro computer 6 outputs the PWM signal PWM1 to the driving unit 7*a*, the PWM signal PWM1 setting the driving unit 7*a* to the lighting current in the dimming lower limit. In addition, the micro computer 6 outputs the PWM signal PWM2 to the driving unit 7*b*, the PWM signal PWM2 setting the driving unit 7*b* to the lighting current in the dimming lower limit.

At a point of time t4, the output voltage VO1 reaches the lighting voltage V1, and thus the LED 2*a* is turned on.

At a point of time t5, the output voltage VO2 reaches the lighting voltage V2, and thus the LED 2*b* is turned on.

With the fourth embodiment of the present invention, the deviation is suppressed by shortening the lighting start time and a lighting timing of the green LED 2*b* is delayed until the red LED 2*a* is turned on by detecting the voltage level of the red LED 2*a* just before the green LED 2*b* is turned on. Accordingly, even though the lighting start time of the LED 2*b* is set faster than that of the LED 2*a* due to a deviation in setting a current or a time constant, it is possible to prevent the LED 2*b* from being turned on prior to the LED 2*a*.

Moreover, it is possible to flexibly respond to a change in setting the current of the LED 2 as a load or a design of the smoothing circuit and to quicken the lighting start even in a state where the current IO of the LED 2 is low, e.g., in the dimming lower limit. In addition, the voltage detecting unit L may perform load failure detection. That is, when a drop in a load voltage is detected due to short-circuit during the lighting, a control can be performed to stop the output of a lighting circuit. Thus, it is possible to operate the lighting system 3 stably.

Through the use of the luminaire 1 in accordance with the above-described embodiments of the present invention, it is possible to perform the lighting start without feeling discomfort in the lighting control and color mixing while effectively reducing flickering.

While the invention has been shown and described with respect to the preferred embodiments, the present invention is not limited thereto. It will be understood by those skilled in the art that various changes and modifications may be made without departing from the scope of the invention as defined in the following claims.

What is claimed is:

1. A lighting system for controlling a plurality of light sources which includes at least a first light source and a second light source, the first light source and the second light source having different luminous colors from each other, the system comprising:

a driving circuit configured to turn on and off each of the light sources; and a control circuit configured to transmit a control signal to the driving circuit in response to an input signal, wherein the second light source has a color temperature and relative luminous efficiency higher than those of the first light source, wherein the driving circuit is configured to supply a voltage to the plurality of light sources based on the control signal so that the lighting system performs at least one of a fade-in control in which the first light source is turned on prior to the second light source when turning on the light sources and a fade-out control in which the second light source is turned off or is dimmed, prior to the first light source when turning off the light sources, wherein the light system further comprises smoothing circuits disposed between the driving circuit and the respective light sources, each of the smoothing circuits including a capacitor and a resistor and having a same time constant, wherein each of the smoothing circuits further includes a voltage detecting circuit to detect a voltage across the corresponding light source connected thereto, and wherein, when turning on the light sources, the control circuit outputs the control signal to the driving circuit, and the driving circuit allows a voltage across the second light source to be maintained under a lighting voltage of the second light source until a voltage across the first light source reaches a lighting voltage of the first light source.

2. The lighting system of claim 1, wherein, in the fade-in control, the first light source is turned on earlier than any other light sources and, in the fade-out control, the second light source is turned off or is dimmed earlier than any other light sources.

3. The lighting system of claim 2, wherein the control circuit comprises:

a lights-out measuring circuit configured to measure a lights-out duration time in response to a turning-off command; and an output circuit configured to receive the measured lights-out duration time from the lights-out measuring circuit and determine a delay time based on the lights-out duration time, wherein a lighting timing at which the second light source is turned on is delayed from a lighting timing at which the first light source is turned on by the delay time when performing the fade-in control.

4. The lighting system of claim 2, wherein the first light source emits a red light, and the second light source emits a green light.

5. A luminaire comprising the lighting system of claim 4.

6. A luminaire comprising the lighting system of claim 2.

7. The lighting system of claim 1, wherein the control circuit comprises:

a lights-out measuring circuit configured to measure a lights-out duration time in response to a turning-off command; and an output circuit configured to receive the measured lights-out duration time from the lights-out measuring circuit and determine a delay time based on the lights-out duration time, wherein a lighting timing at which the second light source is turned on is delayed from a lighting timing at which the first light source is turned on by the delay time when performing the fade-in control.

8. A luminaire comprising the lighting system of claim 1.

* * * * *